United States Patent [19]

Lam

[11] Patent Number: 4,568,197

[45] Date of Patent: Feb. 4, 1986

[54] TIME PIECE

[76] Inventor: Philip Y. T. Lam, P.O. Box 96259, T.S.T., Kowloon, Hong Kong

[21] Appl. No.: 580,479

[22] Filed: Feb. 15, 1984

[30] Foreign Application Priority Data

Feb. 16, 1983 [GB] United Kingdom ..... 8304270

[51] Int. Cl.[4] ..... G04B 19/06; G04B 37/00

[52] U.S. Cl. ..... 368/235; 368/284; 368/78

[58] Field of Search ..... 368/235, 284, 78

[56] References Cited

U.S. PATENT DOCUMENTS

| | | | |
|---|---|---|---|
| 2,576,119 | 11/1951 | Holzner | 368/284 |
| 3,590,571 | 7/1971 | Niznik | 368/235 |
| 3,611,705 | 10/1971 | Niznik | 368/235 |
| 3,950,939 | 4/1976 | Meisner et al. | 368/235 |

*Primary Examiner*—Bernard Roskoski

*Attorney, Agent, or Firm*—Renner, Otto, Boisselle & Lyon

[57] ABSTRACT

A time piece comprising a cylindrical casing formed of transparent material which is closed at its bottom end by a bottom cover on which is mounted a clock movement whose output spindles are drivingly connected by plates to respective drum-like members provided on their outer peripheries with indicia, representing time, the drum-like members being concentrically arranged so that their indicia can be viewed through a window provided on a sleeve mounted on the casing, the inner side of the sleeve comprising a non-transparent sheet which is cut-away in the region of the window. The time is read off the drum-like members in a vertical direction.

12 Claims, 4 Drawing Figures

TIME PIECE

SUMMARY OF THE INVENTION

This invention relates to a time piece, such as a clock.

According to the present invention there is provided a time piece comprising a casing which is at least partly transparent, a clock movement housed within the casing, said clock movement having a plurality of coaxial output drive spindles driven in timed relationship, each spindle being drivingly connected to a respective annular drum-like member provided on its outer periphery with indicia representing time, said drum-like members being coaxially arranged so that the indicia on each drum-like member can be viewed through the casing relative to the indicia of the adjacent drum-like member.

Preferably four drum-like members are provided, one drum-like member indicating seconds, one indicating minutes, one indicating hours and one indicating time settings of an alarm.

Preferably the casing is cylindrical and closed at one end by an end wall, the other end of the casing being closed by a cover on which the clock movement is mounted.

Preferably an outer cylindrical sleeve is mounted on the casing, said sleeve being rotatable relative to the casing and located in position by removable pins which extend through holes in the sleeve and the casing.

BRIEF DESCRIPTION OF THE DRAWINGS

To the accomplishment of the foregoing and related ends, the invention then comprises the features hereinafter fully described and particularly pointed out in the claims, the following description and annexed drawings setting forth in detail an illustrative embodiment of the invention, this being indicative however of only one way in which the principle of the invention may be employed.

In said annexed drawings.

DESCRIPTION OF THE PREFERRED EMBODIMENT

Figure 1:
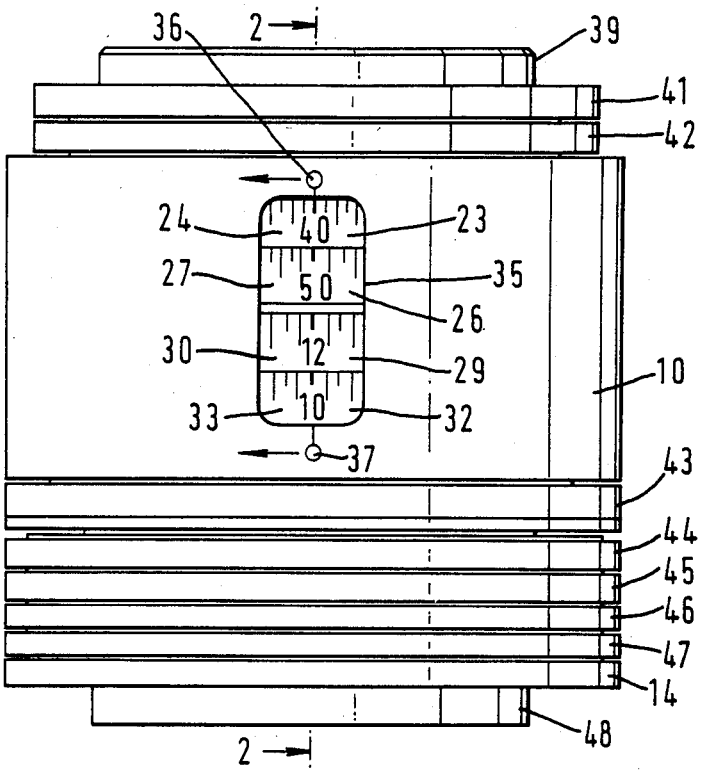
FIG. 1 is a side elevation of a time piece according to the present invention.
Figure 2:
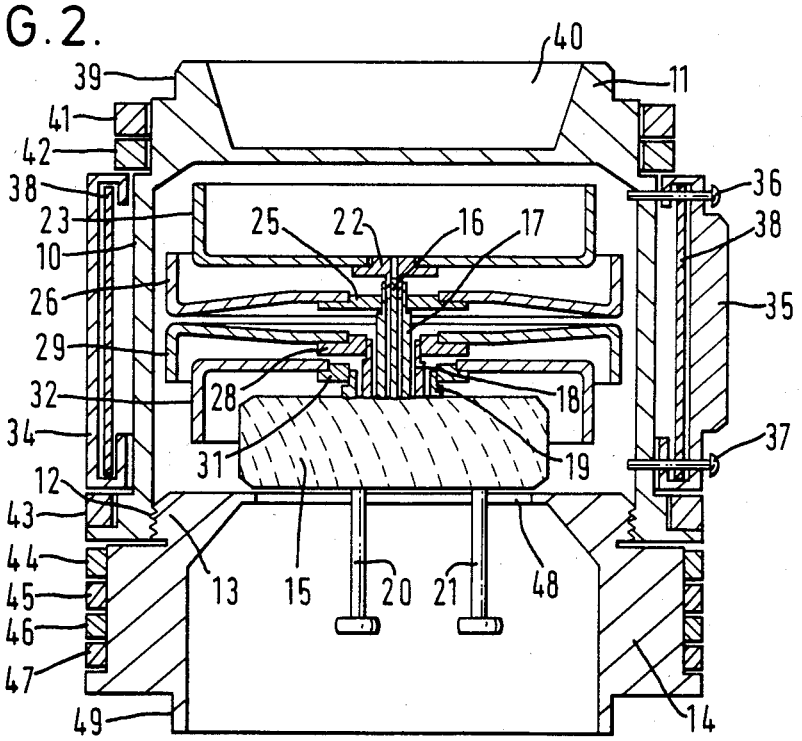
FIG. 2 is a transverse section taken along the line 2—2 indicated on FIG. 1.
Figure 3:
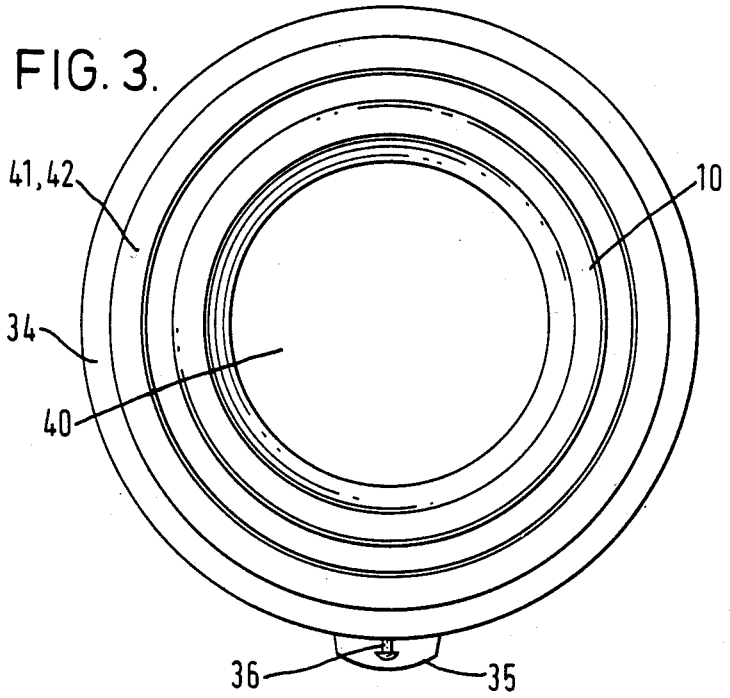
FIG. 3 is a plan view of the time piece.
Figure 4:
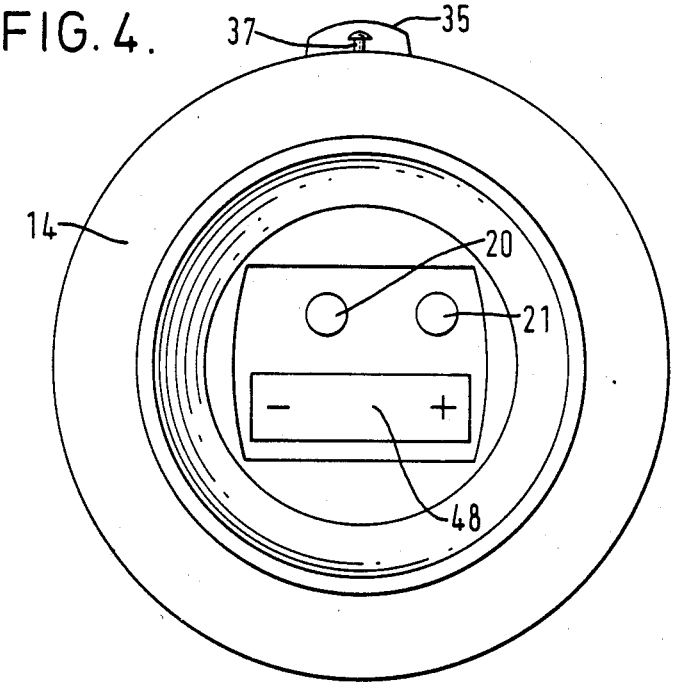
FIG. 4 is a view looking on the underside of the time piece.

The time piece comprises a cylindrical casing 10 formed of a transparent material, the casing 10 having an end wall 11. The bottom end of the casing 10 is internally screw-threaded at 12 and engaged with the screw-thread 12 is a screw-threaded portion 13 of a bottom cover 14.

Mounted on the cover 14 and located within the casing 10 is a clock movement 15 which is preferably a quartz crystal controlled electronic mechanism but which may be a spring powered clockwork movement. In this embodiment the clock movement 15 includes an alarm mechanism but the clock movement may be without such a mechanism. The clock movement 15 is provided with concentric spindles 16, 17, 18 and 19 and has adjusters 20 and 21 which are used for adjusting the time and for adjusting and setting the alarm.

The spindle 16 is connected to a plate 22 on which is mounted a dish 23 whose outer periphery is provided with indicia 24 for indicating seconds. The spindle 17 is connected to a plate 25 on which is mounted a dish 26 whose outer periphery is provided with indicia 27 for indicating minutes. The spindle 18 is connected to a plate 28 on which is mounted a dish 29 provided with indicia 30 for indicating hours. The spindle 19 is provided with a plate 31 on which is mounted a dish 32 whose outer periphery is provided with indicia 33 for indicating the time setting of the alarm.

Surrounding the cylindrical wall of the casing 10 is a transparent cylindrical sleeve 34 which is provided with a window 35. The window 35 is formed by or as a magnifying lens. The sleeve 34 is rotatably mounted on the casing 10 and held in a desired position by pins 36 and 37 which are located above and below the window 35 on an imaginary line which lies in the center of the window 35. Provided on the inside of the sleeve 34 is a sheet of material 38 which in the region of the window 35 is provided with an opening so as not to obscure the window 35. The outer side of the sheet 38 can be provided with printed matter forming advertising material or a decorative pattern etc.

The periphery of the end wall 11 is recessed at 39 to enable the casing 10 to be fitted to another object or device. The top of the end wall 11 is also recessed at 40 to provide a space in which a part or parts of another object or device can be received when fitted to the casing 10. Mounted on the end wall 11 are two rings 41 and 42. The ring 41 may be provided on its outer periphery with a thermo-sensitive material which changes colour when subjected to a predetermined temperature. Different areas of the periphery will have material which change colour at different temperatures so that a range of temperatures can be sensed and displayed. The ring 42 can be provided with indicia indicating the names of major cities in different time zones. By removing the pins 36, 37 and rotating the sleeve 34 so that the window 35 is in line with a particular indicia, the time in the city indicated by the particular indicia can be seen. Mounted on the lower end of the casing 10 is a ring 43 which can be used to indicate the setting time of the alarm.

Provided on the periphery of the cover 14 are rings 44, 45, 46 and 47 which can be provided with indicia to indicate the day, week, month and year or with indicia for effecting convertion from metric to non-metric measurement or vice-versa.

It will be appreciated that the time in hours, minutes and seconds can be determined by viewing the peripheries of the dishes through the window 35 and reading the indicia relative to the line on which the pins 36 and 37 lie. The line may be provided on the window 35.

The upper wall of the bottom cover 14 has an opening 48 to enable access to be gained to a battery for powering the clock movement 15.

The bottom end of the cover 14 is provided with a flange 49 to enable the clock to be mounted on another item.

I, therefore particularly point out and distinctly claim as my invention:

1. A time piece comprising a casing which is at least partly transparent, the casing being cylindrical and closed at one end by an end wall, the other end of the casing being closed by a cover, a clock movement housed within the casing and mounted on the cover of the casing, said clock movement having a plurality of coaxial output drive spindles driven in timed relationship, each spindle being drivingly connected to a respective annular drum-like member provided on its outer periphery with indicia representing time, said drum-like members being coaxially arranged so that the indicia on each drum-like member can be viewed through the casing relative to the indicia of the adjacent drum-like member, and an outer cylindrical sleeve mounted on the casing, said sleeve being rotatable relative to the casing, including a window through which part of the peripheries of the drum-like members can be viewed, and being located in position by removable pins which extend through holes in the sleeve and the casing.

2. A time piece as claimed in claim 1, in which four drum-like members are provided, one drum-like member indicating seconds, one indicating minutes, one indicating hours and one indicating time settings of an alarm.

3. A time piece as claimed in claim 1 or claim 2, in which each drum-like member is connected to its respective spindle through a support plate fixed to the spindle.

4. A time piece as claimed in claim 1, in which said window is formed as a magnifying lens.

5. A time piece as claimed in claim 4, in which the pins consist of two pins located above and below the window on a line which extends through the centre of the window.

6. A time piece as claimed in claim 4 or claim 5, in which a sheet of material is provided on the inner side of the sleeve and movable therewith, the sheet being cut-away in the region of the window and the outer side of the sheet being provided with printed matter which can be viewed through the sleeve.

7. A time piece as claimed in claim 1, in which said one end of the casing is provided with a fixed ring bearing indicia indicating the names of cities in different time zones so that when the sleeve is rotated so that the window is aligned with the indicia representing a particular city the time in that city can be determined.

8. A time piece as claimed in claim 1, in which said one end of the casing is provided with a ring provided with a thermo-sensitive material which changes colour when subjected to a predetermined temperature.

9. A time piece as claimed in claim 8, in which the other end of the casing is provided with a ring which indicates the time setting of the alarm.

10. A time piece as claimed in claim 9, in which the end cover is provided with rings for indicating the day, date, month and year.

11. A time piece as claimed in claim 1, in which the casing is provided at one or each end with a flange enabling the casing to be connected to other members.

12. A time piece as claimed in claim 1, in which the cover is detachable from the casing.

* * * * *